United States Patent [19]

Rohner

[11] Patent Number: 4,529,233

[45] Date of Patent: Jul. 16, 1985

[54] METHOD AND DEVICE FOR TYING AN UPPER THREAD TO A LOWER THREAD

[75] Inventor: Joachim Rohner, Monchen-Gladbach, Fed. Rep. of Germany

[73] Assignee: W. Schlafhorst & Co., Monchen-Gladbach, Fed. Rep. of Germany

[21] Appl. No.: 409,867

[22] Filed: Aug. 20, 1982

[30] Foreign Application Priority Data

Aug. 20, 1981 [DE] Fed. Rep. of Germany ..... 3132895

[51] Int. Cl.[3] ..... B65H 69/06

[52] U.S. Cl. ..... 289/1.5; 289/2; 289/18.1

[58] Field of Search ..... 289/1.2, 1.5, 2, 18.1; 28/209; 57/22, 23, 202

[56] References Cited

U.S. PATENT DOCUMENTS 2,705,656 4/1955 Shockey ..... 289/1.5 X

FOREIGN PATENT DOCUMENTS 2945504 5/1981 Fed. Rep. of Germany .

*Primary Examiner*—Louis K. Rimrodt

*Attorney, Agent, or Firm*—Herbert L. Lerner; Laurence A. Greenberg

[57] ABSTRACT

Method of tying an upper thread to a lower thread by means of a device having a splicing chamber formed with an elongated slot for laying-in and tying the threads, including mutually tying the threads by splicing with compressed air acting thereon from a side, moving a thread regulator from a thread take-up location to a thread delivery location for laying-in the threads into the elongated slot of the splicing chamber, automatically severing the ends of the upper and the lower threads, blowing compressed air into the splicing chamber, and sucking in and firmly holding each newly formed shorter thread end by means of an air current, which comprises producing the air current for sucking-in and firmly holding the thread ends as a suction air current by means of an injector to which compressed air is admitted, and guiding the suction air current simultaneously in an approximately helical path, and a device for carrying out the method.

15 Claims, 10 Drawing Figures

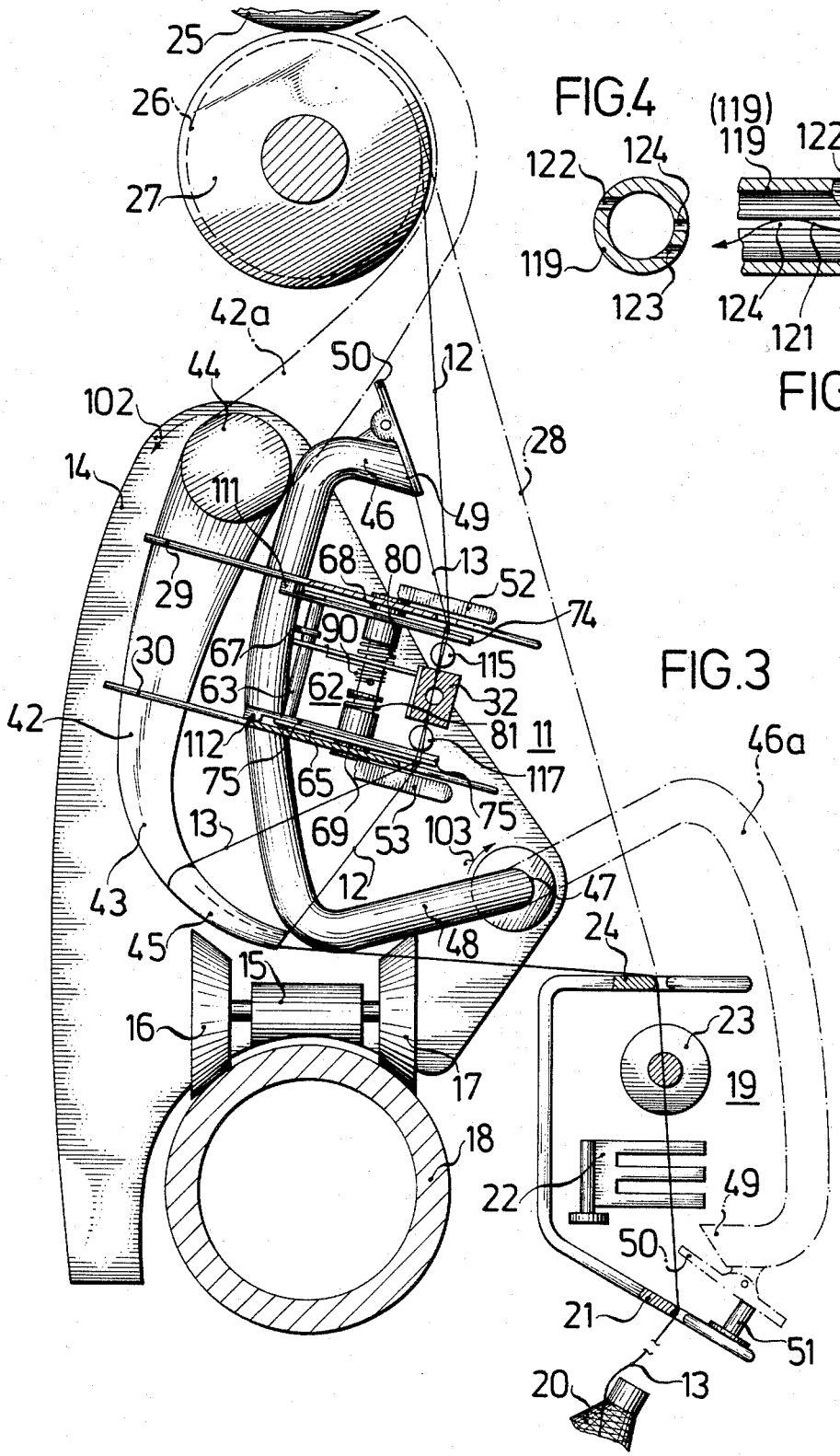
FIG.3
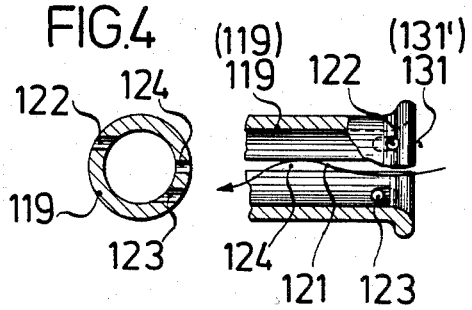
FIG.4
FIG.5

METHOD AND DEVICE FOR TYING AN UPPER THREAD TO A LOWER THREAD

The invention relates to a method and a device for joining or tying an upper thread to a lower thread, more particularly, by means of a device having a splicing chamber with an optionally coverable elongated slot for laying-in and tying the threads. In the device, the threads are tied to one another by splicing by means of compressed air acting thereon from the side, the laying-in of the threads into the elongated slot of the splicing chamber being effected by means of at least one movable thread regulator which is moved from a thread take-up location to a thread delivery location, the splicing chamber being optionally closed by a cover depending upon the location of the thread regulator, the ends of the upper thread and of the lower thread being automatically severed, compressed air being blown into the splicing chamber and each shorter thread end newly formed after the severing operation being sucked in and held fast by an air current.

It has become known heretofore from German Published Non-Prosecuted Application (DE-OS) No. 59 45 504 to suck in and hold fast by means of a suction air current each shorter thread end newly formed after the severing operation. For this purpose, a suction-air source is additionally required. Since it is difficult, however, to stabilize the suction air, and the action of the suction air on the thread ends does not result in a satisfactory releasing and loosening of the fibers of the thread ends, splicing locations develop which are of quite different quality.

It is accordingly an object of the invention to provide a method and device of the foregoing general type with which the splicing operation is stabilized, the thread ends to be spliced to one another are made ready better, and the fibers are released and loosened better. More worth objects of the invention which are associated therewith are to provide such a method and device which provide an increased quality of the splicing connection and an increased reliability of the splicing operation, and especially also an improved strength and appearance of the splice and an expansion of the application of the thread splicing to threads of greater fineness, so as to reduce technical expense thereby.

With the foregoing and other objects in view, there is provided, in accordance with the invention, a method of joining or tying an upper thread to a lower thread by means of a device having a splicing chamber formed with an elongated slot for laying-in and tying the threads, including mutually tying the threads by splicing with compressed air acting thereon from a side, moving a thread regulator from a thread take-up location to a thread delivery location for laying-in the threads into the elongated slot of the splicing chamber, automatically severing the ends of the upper and the lower threads, blowing compressed air into the splicing chamber, and sucking in and firmly holding each newly formed shorter thread by means of an air current, which comprises producing the air current for sucking-in and firmly holding the thread ends as a suction air current by means of an injector to which compressed air is admitted, and guiding the suction air current simultaneously in an approximately helical path.

Further in accordance with the invention and, more particularly, for performing the foregoing method, there is provided a method wherein the elongated slot is coverable, and which includes closing the elongated slot with a cover in accordance with the position of the thread regulator.

In accordance with another aspect of the invention, there is provided a device for performing the method of tying an upper thread to a lower thread comprising a splicing chamber formed with an elongated slot for inserting and tying the threads therein, a compressed-air channel terminating in an interior space of the splicing chamber, at least one thread regulator movable from a thread take-up position into a thread delivery position for laying the threads into the elongated slot of the splicing chamber, and controllable parts depending upon the position of the thread regulator including thread severing mechanisms for separating the ends of the upper and the lower threads, a controllable compressed-air closing valve, a pneumatic device located above the splicing chamber for taking-up the shortened thread end of the lower thread, a pneumatic device disposed below the splicing chamber for taking-up the shortened thread end of the upper thread, at least one of the pneumatic devices having an injector to which compressed air is admissible, a pneumatic line extending from the injector to a thread suction mouthpiece, the pneumatic line having at least one lateral opening therein for admitting thereto a flow of surrounding air.

In accordance with a further aspect of the invention, there is provided a device wherein the elongated slot is coverable, and including a cover for transitorily closing the splicing chamber.

In accordance with an added aspect of the invention, the at least one lateral opening is an elongated slot.

In accordance with an additional aspect of the invention, the at least one lateral opening is a plurality of openings.

In accordance with again another aspect of the invention, the at least one lateral opening comprises an elongated slot and a plurality of other openings.

In accordance with again a further aspect of the invention, the at least one lateral opening is adjustable.

In accordance with again an added aspect of the invention, the at least one lateral opening is closable.

In accordance with again an additional aspect of the invention, the pneumatic line has means for closing the lateral opening.

In accordance with yet another aspect of the invention, the closing means comprise a rotary slide valve.

In accordance with yet a further aspect of the invention, the thread suction mouthpiece flares funnel-like outwardly.

In accordance with yet an added aspect of the invention, there is provided a common compressed air source connected to the splicing chamber and to the injector.

In accordance with yet an additional aspect of the invention, the compressed-air dosing valve is common to both the splicing chamber and the injector.

In accordance with a concomitant aspect of the invention, the at least one lateral opening is directed opposite to the direction of twist of the threads.

Advantages achieved with the invention are especially that the thread ends are made ready better for the splicing operation. The sucking-in of the thread ends occurs more uniformly. Due to the somewhat helically guided suction air current, the fibers are released and loosened better, short fibers which can contribute nothing to the strength of the splice being sucked away. It is no longer necessary to have a special suction air source.

The compressed air source which is already present is sufficient for producing the suction air.

All of the operations are coordinate with one another. The instant and the duration of each of the important operations are adjustable, a feature which applies especially to the instant and the duration of the air injection, the severing or separation of the excess thread ends and the sucking-in of the shortened thread ends by means of the pneumatic devices.

The device for tying the upper thread with the lower thread may advantageously be a device which travels from work station to work station.

Other features which are considered as characteristic for the invention are set forth in the appended claims.

Although the invention is illustrated and described herein as embodied in a method and device for joining or tying an upper thread to a lower thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a simplified, side elevational view, partly in section, of the device of the invention;

FIGS. 4 and 5 are fragmentary enlarged cross-sectional and longitudinal sectional views, respectively, of FIGS. 1 and 2 showing a pneumatic line with a thread suction mouthpiece.

Figure 1:
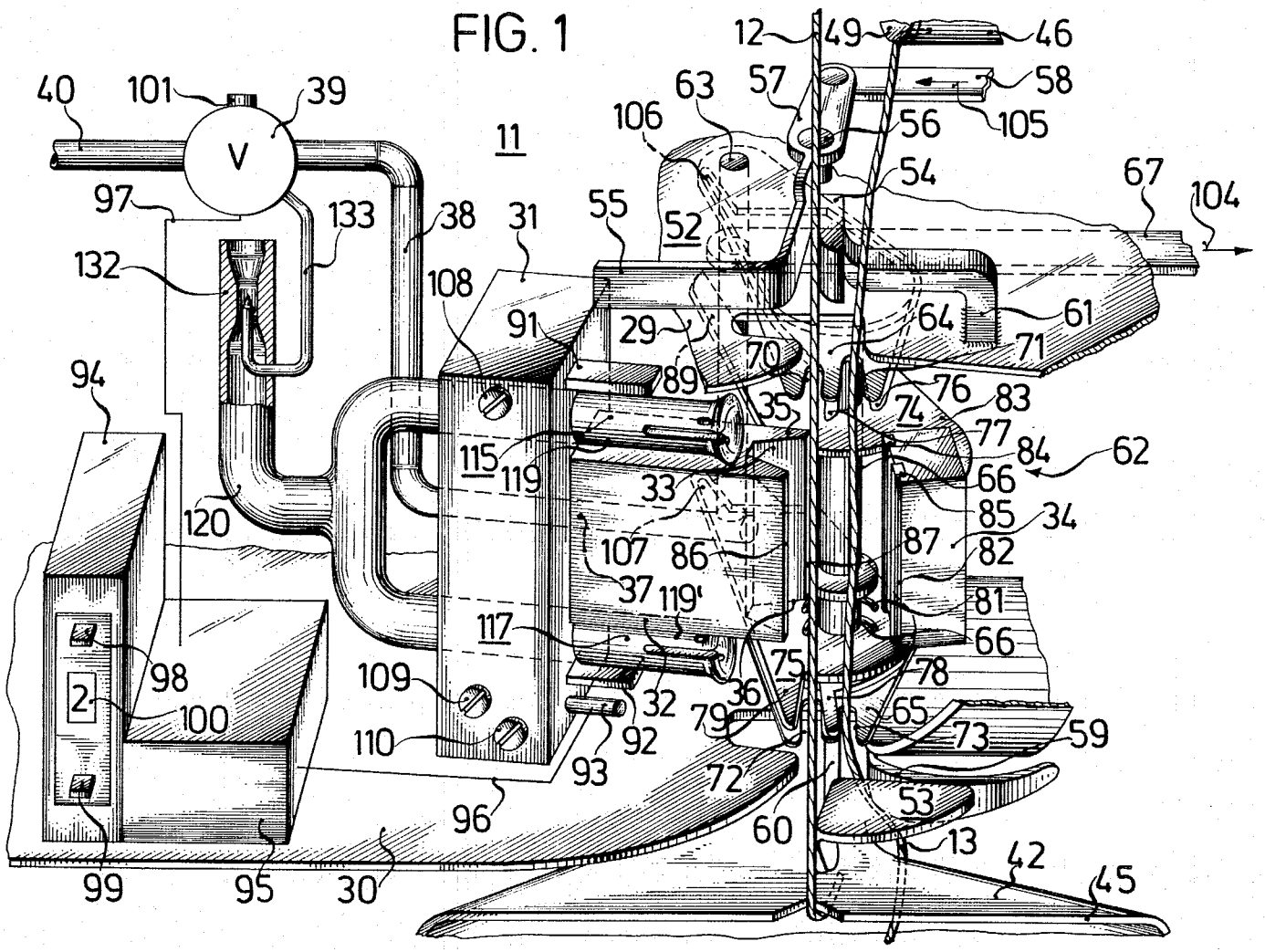
FIG. 1 is a perspective view of the device for tying an upper thread with a lower thread in accordance with the invention, wherein the splicing chamber thereof is opened.

The embodiment of the device of the invention according to FIG. 1 has a common injector for both pneumatic lines and the thread suction mouthpiece thereof. The embodiment of the device according to FIG. 2 differs from that of FIG. 1 only in that each pneumatic line in FIG. 2 has its own injector.

Figure 2:
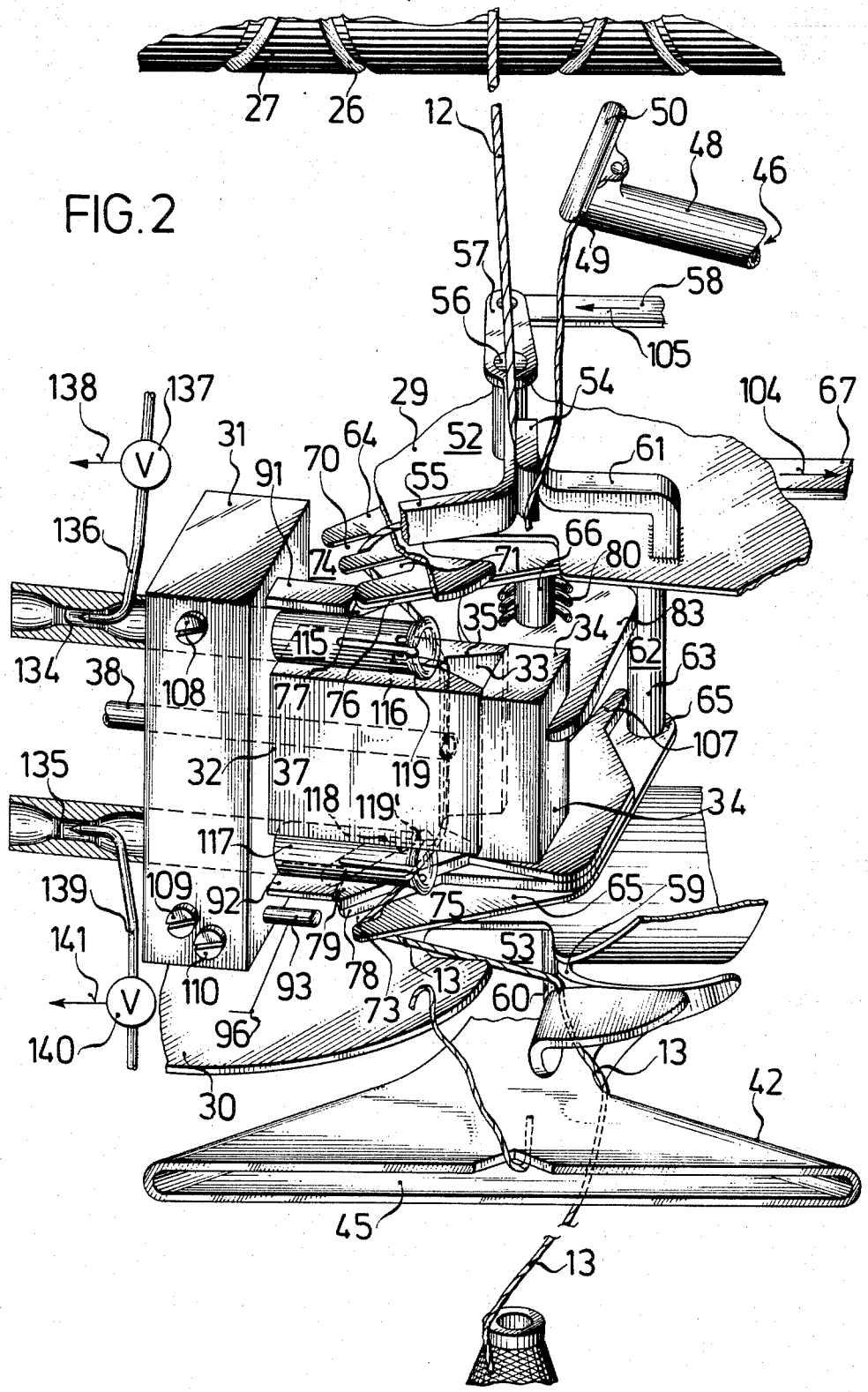
FIG. 2 is a view similar to that of FIG. 1 of another embodiment of the device according to the invention wherein the splicing chamber is closed.

The following description of FIG. 1 applies as well to FIGS. 2 and 3 except for the just-mentioned differences. The differences are not applicable to FIG. 3 because the injector is not shown therein.

Referring now more specifically to FIGS. 1 to 3 of the drawing, there is shown therein a device, identified as a whole by reference numeral 11, for joining or tying an upper thread 12 with a lower thread 13. The device 11 has a machine frame 14 which, according to FIG. 3, carries an undercarriage or chassis 15 having rollers 16 and 17 with the aid of which the device 11 is able to travel on a supporting pipe 18.

The supporting pipe 18 extends along a winding machine of which only one winding station 19 is visible in FIG. 3. The device 11 happens to be in action at this winding station 19. The lower thread 13 extends from a creel bobbin or supply coil 20 via a thread guide 21, a rake sensor 22, a thread brake 23 and a further thread guide 24 to the device 11 at the winding station 19. The upper thread 12 extends from a take-up or winding coil 25 over a rotating thread guiding cylinder 27 provided with reverse winding grooves 26, likewise to the device 11.

In the narrow sense, the device supplying the lower thread 13 is formed of the thread guide 21, and the device taking up the upper thread 12 is formed of the take-up or winding coil 25. The line of the shortest possible, uninfluenced and undisturbed thread course or path is identified by the reference numeral 28.

The line 28 is shown in phantom to signify that the course of the thread has already been disrupted and the thread per se has been separated into an upper thread and a lower thread.

The device 11 has two plates 29 and 30 fastened to the machine frame 14 and connected to one another by a beam 31. A splicing chamber 32 is fastened to the beam 31 and is formed with an elongated slot 33 which may be closed by a cover 34. When the cover 34 is opened, the threads can be introduced into the elongated slot 33 of the splicing chamber 32. The edges 35 and 36 at the mouth of the elongated slot 33 are rounded. A compressed-air channel 37 terminates in the interior space of the splicing chamber 32 formed by the elongated slot 33 and the cover 34. The compressed-air channel 37 continues in a pipeline 38 leading to a compressed-air dosing or metering valve 39. Via a pipeline 40, the compressed-air dosing valve 39 is connected with an otherwise non-illustrated compressed-air source.

A thread regulator 42 is provided with means for searching for or locating and holding fast the thread end of the upper thread 12 on the take-up coil 25. These means are formed of an inner hollow arm 43 which is connected via a swivel joint 44, to an otherwise non-illustrated vacuum source, as well as of a suction slit nozzle 45. FIG. 3 shows the thread regulator 42 in the thread delivery position thereof. The thread take-up position thereof is identified by the reference character **42*a* and is represented by a line in phantom in FIG. 3**.

A further pivotal thread regulator 46 is provided with means for locating and firmly holding the thread end of the lower thread 13. These means are formed of a curved pipe 48 turnable in the swivel joint 47 and having a suction nozzle 49 which is closed by a clamping cover 50 by spring force. The thread regulator 46 is also shown in FIG. 3 in the thread delivery location thereof. The thread take-up location thereof is identified by reference character **46*a* and is represented by a line in phantom in FIG. 3. To take up the thread end of the lower thread 13, the clamping cover 50 is opened by engagement with a stop 51. The thread 13 torn or broken somewhat above the thread brake 23 can then be sucked in by the suction nozzle 49 and, when the thread regulator 46 swings back into the thread delivery position thereof, can be clamped between the clamping cover 50 and the edge of the suction nozzle 49**, firmly held and entrained.

Two controllable thread gripping devices 52 and 53 are recognizable from the figures of the drawing. The thread gripper 52 is located above the splicing chamber 32 and also above the plate 29, while the thread gripper 53 is disposed below the splicing chamber 32 and also below the plate 30. Each of the two thread grippers 52 and 53 is of bipartite construction. The thread gripper 52 has a stationary gripper member 54 and a controllable gripper member 55 which is pivotable about a swivel joint 56 and has a lever 57 which is controllable by means of a rod 58 through an otherwise non-illustrated cam disk. The thread gripper 53 has a stationary gripper member 59 and a controllable gripper member 60 which is controllable like the gripper 52 by means of an otherwise non-illustrated cam disk. The gripper member 54 is connected by a yoke or stirrup 61 to the plate 29. The gripper member 59 is connected to the plate 30.

Further shown in the figures of the drawing is a pivotal, two-armed thread regulator 62 formed of a pin 63 with arms 64 and 65 fastened thereto. The thread regulator 62 is rotatably supported on a shaft 66 connecting the plate 29 to the plate 30. A rod 67 is movably connected to the pin 63 for swinging the thread regulator 62 about the shaft 66.

Spacers 68 and 69 serve for centering the thread regulator 62 which can be swung from the thread take-up position thereof represented in FIG. 1 to the thread delivery position thereof represented in FIG. 2. The pivot plane of the arm 64 lies above and the pivot plane of the arm 65 below the splicing chamber 32. In the thread take-up position, the two arms of the thread regulator 62 lie in the course of the parallel-lying threads 12 and 13, after the thread regulators 42 and 46 have swung into the thread delivery positions thereof.

Each arm of the thread regulator 62 has two mutually adjacent thread take-up slots of unequal depth. It is apparent from FIGS. 1 and 2 that the thread take-up slot 71 of the arm 64 is deeper than the thread take-up slot 70. Likewise, the thread take-up slot 72 of the arm 65 is deeper than the thread take-up slot 73. These unequally deep thread take-up slots are so disposed that, respectively, the less deep thread take-up slot of the arm lies in alignment above the deeper thread take-up slot of the other arm. In the thread take-up position of the thread regulator 62, the thread take-up slots lie somewhat in the pivot plane of the thread regulators 42 and 46.

Each arm of the thread regulator 62 has a controllable thread severing mechanism, and indeed the thread severing mechanism 74 is associated with the arm 64, and the thread severing mechanism 75 with the arm 65. Each thread severing mechanism is formed of two scissor-like cooperating knives. One knife is connected, respectively, with the appertaining arm, and the other knife, indeed, respectively, the knife lying toward the splicing chamber 32, is supported so as to be pivotable about the shaft 66. The knife 76 of the thread severing mechanism 74 is connected, for example, to the arm 64, while the knife 77 of the same thread severing mechanism is pivotally supported. The knife 78 of the thread severing mechanism 75 is connected to the arm 65, while the knife 79 of the same thread severing mechanism is pivotally supported. It is especially apparent from FIG. 2 that the knife 77 is pressed by a helical spring 80 towards the knife 76. It is clear from FIG. 1 that also the knife 79 is pressed by a helical spring 81 towards the knife 78. The helical spring 81 is braced against a disk 82 fastened onto the shaft 66. The helical spring 80 is braced against a pivot arm 83 rotatably supported on the shaft 66 and carrying the cover 34 of the splicing chamber 32. The cover 34 has inserts or inlays 84 and 85 formed of sealing material which, when closing, are laid against the edges 86 and 87 of the alongated slot 33 and thereby prevent compressed air and individual fibers from escaping out of the chamber 32. The thread regulator 62, the thread severing mechanisms 74 and 75 and the pivot arm 83 of the cover 34 have not only a common pivot shaft 66, but also are pivotable together. For this purpose, the pivot arm 83 carries at the rear end thereof a lever 89 which lays against the pin 63 under the action of a wound bending or torsion spring 90. While the two knives 76 and 78 are connected to the arms 64 and 65, respectively, the pivotal knives 77 and 79 are likewise entrained under the action of the helical springs 80 and 81 during the swing of the thread regulator 62. This entrainment of the knives 76 and 78 is limited by adjustable stops 91 and 92. The adjustability is afforded by clamping screws 108 and 109. Therewith, the instant of severance of the thread ends can be adjusted accurately and coordinated with the instant of the introduction of compressed air or the blowing time. If the thread regulator 62 is then swung into the position thereof represented in FIG. 2, the thread severing mechanism 74 and 75 close, whereby the lever 106 of the knife 77 and, likewise, a similar lever 107 of the knife 79 lift themselves from the pin 63. The thread severing mechanism are then closed scissor-like. When the thread regulator 62 swings back into the thread take-up position thereof, the pin 63 is laid against the levers 106 and 107 whereby, with further swinging, the thread severing mechanisms are again opened scissor-like. The thread severing mechanisms 74 and 75 are so disposed that they, respectively, become active at the thread take-up slots wherein the thread ends to be severed are lying, that is, the thread take-up slot 71 for the arm 64, and the thread take-up slot 72 for the arm 65. It is apparent from FIG. 2 that the thread take-up slots of the thread regulator 62 in the represented thread delivery position are disposed at an inclination, respectively, above and below, behind the edges 35 and 36 of the mouth of the chamber 32, the threads embracing the edges 35 and 36 of the chamber mouth.

The compressed-air dosing valve 39 is controllable by means of a proximity switch 93 responsive to the movement of the thread regulator 62 and adjustable in the position thereof on the beam 31 by means of a clamping or set screw 110, and adjustable by means of a time switch device 94 and also simultaneously controllable. For this purpose, the parts 39, 93 and 94 are fastened to a switch box 95 wherein an electric switching device is located. The adjustability of the proximity switch 93 ensures the exact adjustment of the start of the air injection depending upon the position of the thread regulator 62, and of the end of the air injection also therewith depending upon the position of the thread severing mechanisms and the instant the thread ends are severed. Also shown in FIG. 1 are the line 96 leading to the proximity switch 93 and the line 97 leading to the compressed-air dosing valve 39. The time switch device 94 has a switch 98 for adjusting the blowing time and a visible indicator 100 for displaying the adjusted blowing time. The compressed-air dosing valve 39 has a pressure adjusting device 101.

It is also apparent from FIGS. 1 and 2 that some parts of the device 11 have special thread guide contours. This is the case, for example, for the suction slit nozzle 45, for the thread grippers 52 and 53 and for the plates 29 and 30.

Barely above the splicing chamber 32, there is a pneumatic device 115 for taking up the shortened thread end 116 of the lower thread 13, and just below the splicing chamber 32, there is a pneumatic device 117 for taking up the shortened thread end 118 of the upper thread 12. Both pneumatic devices 115 and 117 have similar pneumatic lines 119, 119' and thread suction mouthpieces 131, 131′ which are represented especially in cross section and longitudinal section, respectively, in FIGS. 4 and 5. Both pneumatic lines terminate in a collection line or manifold 120. The thread suction nozzles 119 serve as thread take-up elements. At the end of the collection line 120, an injector 132 subjectible to compressed air is located.

It is apparent from FIGS. 4 and 5 that the pneumatic line 119, in the vicinity of the thread suction mouthpiece 131, has two openings 122 and 123 directed tangentially and simultaneously in longitudinal direction of the arrow 121, as well as an opening 124 in the form of an elongated slot. Due to the air flowing in the direction of the arrow 121 and the air simultaneously flowing in through the bores 122 and 123, a somewhat helical twisted or torsional flow is formed. The bores 122 and 123 are directed opposite to the direction of the thread twist. In a batch exchange with threads of other twist, the lines 119, 119′ with the thread suction mouthpieces are exchanged. They are, for this purpose, inserted into the beam 31 so as to be easily exchangeable.

From the compressed-air dosing valve 39, a line 133 extends to the injector 132. The compressed-air dosing valve 39 is made so that, when turned on, first the line 133 and then the line 38 are subjected to compressed air. Thus, before the splicing begins, the thread ends are initially sucked in and pretreated.

In the modified embodiment of the invention shown in FIG. 2, the pneumatic device 115 has an injector 134, and the pneumatic device 117 an injector 135. The blow pipe 136 of the injector 134 is connected via a compressed-air dosing valve 137 to an otherwise non-illustrated compressed-air source and via a control line 138 to the time switch device 94. The blow pipe 139 of the injector 135 is connected via a compressed-air dosing valve 140 to an otherwise non-illustrated compressed-air source and via a control line 141 likewise to the time switch device 94.

In light of the figures of the drawing, the functioning and operation of the device according to the invention, for example, of a thread tying operation are explained hereinafter.

It is assumed initially that, at the winding station 19 of a spinning machine, the thread previously extending along the line 28, has broken. An upper thread 12 and a lower thread 13 have thus been formed. The upper thread 12 had been taken-up by the take-up or winding coil 25, while the lower thread 13 has become firmly held due to the thread brake 23 in conjunction with the rake sensor 22.

The break in the thread is determined in a conventional manner by non-illustrated means, and the travelling device 11 has been informed thereof. According to FIG. 3, the device 11 has travelled on the supporting pipe 18 in front of the winding station 19. The thread regulators 42 and 46 are in rest position, which is identical with the thread delivery position, as long as the threads already illustrated in FIG. 3 are ignored. The third thread regulator 62 is in the thread take-up position represented in FIG. 1. The illustrated threads should be considered initially as not being present. The device 11 then acts in the following manner:

In the machine frame 14, an otherwise non-illustrated control transmission or gear system which starts up in response to a signal automatically issued by the winding station 19 and turns the swivel joint 44 of the thread regulator 42 in the direction of the arrow 102 until the thread regulator 42 has reached the thread take-up position 42*a*. In the latter position, the suction slit nozzle 45 is located closely in front of the surface of the take-up coil 25. The suction slit nozzle 45 extends over the entire breadth of the take-up coil. Due to the vacuum acting on the suction slit nozzle 45, the thread end of the upper thread 12 is located, sucked-in and firmly gripped, when the take-up coil 25 rotates slowly and is running toward empty, respectively. Simultaneously, the control transmission or gear system rotates the swivel joint 47 of the thread regulator 46 in the direction of the arrow 103, until the thread regulator 46 has reached the thread take-up position 46*a*. The clamping or gripping cover 50 travels there against the stop 51 and accordingly opens. Then, the vacuum acting on the suction nozzle 49 sucks in and firmly holds the thread end of the lower thread 13.

After a firmly adjusted brief action period, the control transmission turns the two swivel joints 44 and 47 back into the starting positions. Both thread regulators 42 and 46 simultaneously swing into the thread delivery positions represented by the solid lines in FIG. 3. During the swing of the thread regulator 46, the clamping cover 50 closes again and thereby clampingly holds the thread end.

When the thread regulators 42 and 46 swing back from the position indicated in phantom in FIG. 3 into the position represented by the solid lines, the threads are introduced into the thread take-up slots of the thread regulator 62, as is also shown in FIG. 1. The hereinaforementioned thread guiding contours ensure that the upper thread 12, coming from the take-up coil 25, is laid in between the gripper member 54 and the gripper member 55 of the thread gripper 52 and into the thread take-up slots 70 and 72 of the thread regulator 62. The lower thread 13, coming via the thread guide 21 from the delivery or supply coil 20, is inserted into the rake sensor 22, the thread brake 23 and the thread guide 21, is guided over the rear side of the suction slit nozzle 45 of the thread regulator 42, conducted between the gripper member 59 and the gripper member 60 of the thread gripper 53 and laid into the thread take-up slots 73 and 71 of the thread regulator 62. Since both thread regulators 42 and 46 swing back simultaneously, the rounded rear side of the suction slit nozzle 45 entrains the lower thread 13 ahd deflects it as shown in FIG. 1 of the drawing. During the swinging movement of the thread regulators 42 and 46, the thread grippers 52 and 53 are opened.

Then, an otherwise non-illustrated control system sets two likewise non-illustrated cam disks in motion which ensure that the rod 67 is drawn, out of the positions represented in FIG. 1, in the direction of the arrow 104, and the rod 58 in the direction of the arrow 105. During the movement of the rod 67, both arms of the thread regulator 62 and the pivot arm 83 of the cover 34 swing towards the left-hand side, as viewed in FIG. 1. Due to the unequal depths of the thread take-up slots, the threads are laid mutually crosswise into the elongated slot 33 of the splicing chamber. Both thread severing mechanisms are opened yet. Shorthly before reaching the end position represented in FIG. 2, which is equivalent to the thread delivery position as far as the thread regulator 62 is concerned, the cover 34 is disposed, with the inlays 84 and 85 thereof, against the edges 86 and 87 of the elongated slot 33 of the splicing chamber 32. Simultaneously, both thread grippers 52 and 53 close, while the knives 77 and 79 engage with the stops 91 and 92, respectively. At the same instant, the proximity switch 93 detects the approach of the arm 65 of the thread regulator 62. The proximity switch 93 initiates, in the embodiment of the device shown in FIG. 1, via the electric switching device located in the switch box 95, the turning on of compressed-air dosing valve 39 for the blowing periods adjusted at the time switch device 94. The injector 132 has precedence or priority. Beforehand, both arms of the thread regulator 62 swing further towards to left-hand side so that they finally reach the end position shown in FIG. 2. Meanwhile, the thread severing devices come into action and the excess thread ends are severed and sucked away, respectively, held tightly by the clamping or gripping cover 50, while both newly formed thread ends 116 and 118 are then sucked in by the pneumatic devices 115 and 117, separated into fibers and held. This ensures also a pulling of the threads, in case the splicing operation requires it.

In the modified embodiment of FIG. 2, the proximity switch 93, via the electric switching device located in the switch box 95, initiates the turning-on of the compressed-air dosing valve 39 and, with temporal precedence or priority, via the time switch device 94, the turning-on of both compressed-air dosing valves 137 and 140 of the two injectors 134 and 135 for the blowing times set at the time switch device 94. Beforehand, the thread regulator and the thread severing mechanisms operate as previously described herein with respect to FIG. 1.

After the splicing operation, the thread regulator 62 is brought out of the end position thereof shown in FIG. 2, without delay, again into the normal position thereof and the thread grippers are opened, the cam disks ensuring that the rod 67 is moved back opposite the direction of the arrow 104 and the rod 58 opposite the direction of the arrow 105. At the beginning of this return movement, the thread severing mechanisms continue to remain closed initially for a limited time, namely until the pin 63 has reached the two levers 106 and 107, after which the thread severing mechanisms can first be opened again. Also, the cover 34 is opened with a time delay, and indeed also only again from the instant at which the pin 63 has reached the lever 89 of the pivot arm 83. Depending upon the force of the springs 80, 81 and 90, the resetting of the thread severing mechanisms and the full opening of the cover 34 is achieved only when the pin 63 has been returned so far by the rod 67 as is shown in FIG. 1. The backs of the levers 106 and 107 have placed themselves against the stops 111 and 112. The instant of splicing may be set selectively before or after the instant of severing of the thread ends.

The thread tied by splicing with compressed air at the end of the process is located finally in the opened thread gripper 75, in the thread take-up slot 73 of the arm 65 in front of the opened slicing chamber 32, in the thread take-up slot 70 of the arm 64 and in the opened thread gripper 52.

The twisted or torsional flow prevailing in the pneumatic lines 119 and 119' acts upon the thread ends 116 and 118 during the entire suction period, loosens the individual fibers and transports the loosened individual fibers, insofar as they are not bound into the splice, forward therewith. After the splicing operation, only short ends formed of individual fibers are therefore yet present at the splice.

If the winding station 19 is thereafter again set into operation, the thread springs or jerks out of the device 11 due to the winding tension reintroduced therein and assumes a thread course or path in accordance with the line 28 in FIG. 3. The activity of the device 11 is then ended, and the device 11 can then travel to another location at which it will be used. The thread is again located outside the travel range of the device 11.

The lines of the pneumatic devices 115 and 117 have a pipelike appearance in the embodiments of FIGS. 1 and 2. This is advantageous if, alternatingly, threads with a Z-twist and threads with an S-twist are spliced, because pipelike lines are able to be exchanged quite readily. It may be advantageous, however, to provide channel-type lines, such as according to FIGS. 6 to 10, for example, for pneumatic devices. Such channel-type lines can be machined beforehand into a support member of the splicing chamber 32 or machined into a projection of the splicing chamber 32 per se. When there is a change in the thread twist, the entire splicing chamber, optionally inclusive of the support member thereof, is then exchanged or replaced.

Figure 6:
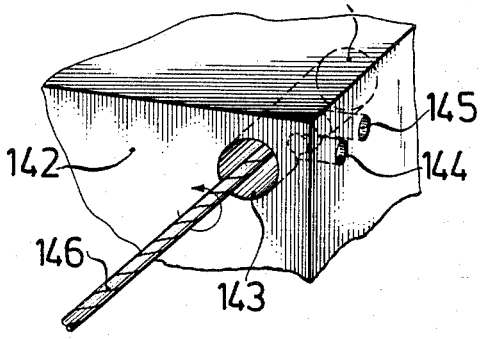
FIGS. 6 to 10 are enlarged perspective views of further embodiments of the pneumatic line.

In this regard, FIG. 6 shows a support member 142 with a pneumatic line 143 formed as a bore, which has lateral openings 144 and 145. The previously sucked-in thread 146 has a Z-twist.

Also, in the embodiments according to FIGS. 7 to 10, the pneumatic lines are constructed from concept as bores which are modified by slots at the thread entrance side.

Figure 7:
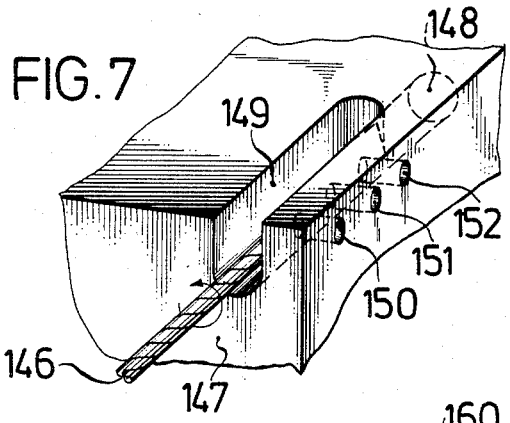

FIG. 7 shows, for example, a support member 147 with a line 148. A lateral opening 149 is formed of a slot in the breadth of the line 148, with further openings 150, 151 and 152 being formed of lateral bores.

Figure 8:
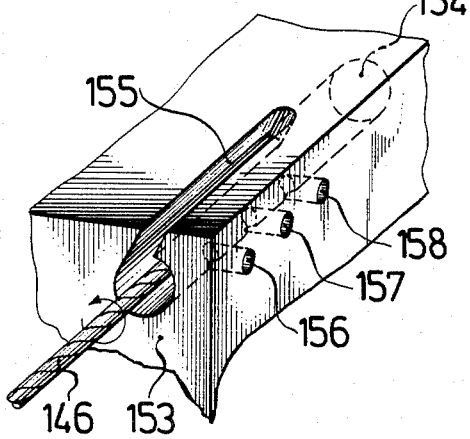

FIG. 8 shows a support member 153 with a line 154. A lateral opening 155 is formed of a tangentially extending slot. Three additional lateral openings 156, 157 and 158 are bores.

Figure 9:
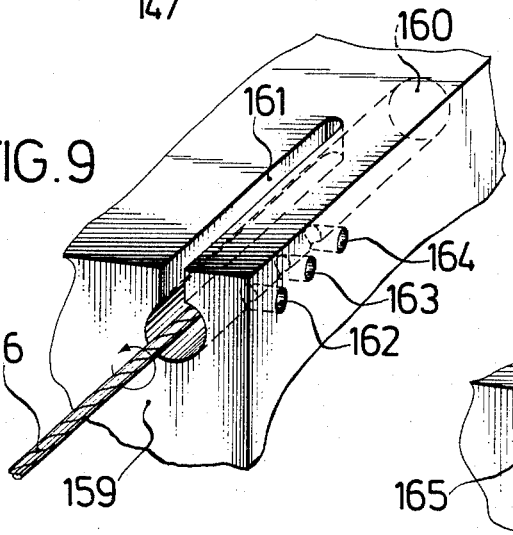

FIG. 9 shows a support member 159 with a line 160. A lateral opening 161 is formed of a slot, and three further openings 162, 163 and 164 are formed as bores.

Figure 10:
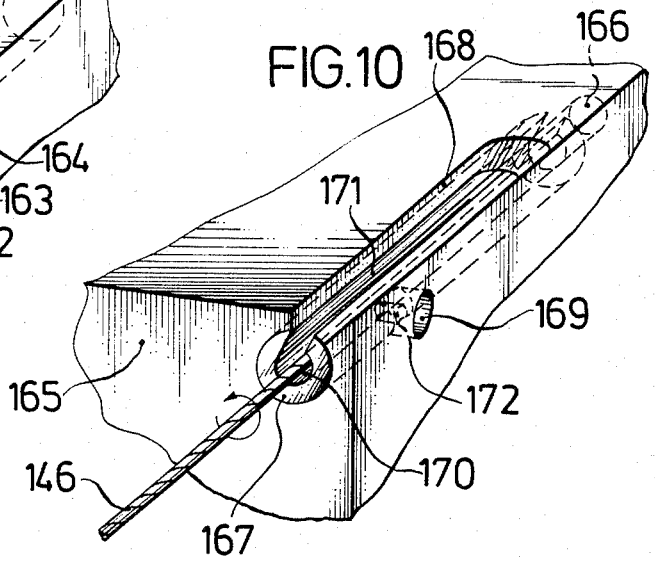

FIG. 10 shows a support member 165 with a line 166. The line 166 is widened from an end thereof by a larger bore in which an adjustable closure device in the form of a rotary slide valve 167 is inserted. A broad or wide slot 168 extends outwardly from an edge of the support member 165 to the rotary slide valve 167. From the right-hand side wall of the support member 165, as viewed in FIG. 10, a bore likewise extends up to the rotary slide valve 167.

The rotary slide valve 167 has a central bore 170 with a diameter coinciding with that of the channel-type line 166. The actual openings permitting the lateral in-flow of the surrounding air are disposed here in the rotary slide valve 167, namely an opening 171 in the form of a tangentially extending slot and an opening 172 in the form of a bore. By rotating the rotary slide valve 167, the openings may be reduced as desired or closed entirely.

In the example according to FIGS. 6 and 10, the openings, respectively, are disposed in two planes differing from one another. Insofar as slots are provided, they terminate in the thread suction mouthpieces which form no special inserts here. A helical type suction air current results, due to which the threads 146 are twisted in the direction of the curved arrow. A funnel-type flaring or widening of the thread suction mouthpieces is also advantageous here, but have nevertheless not been illustrated in the drawing.

As noted hereinafore, the invention is not limited to the embodiments illustrated and described herein.

The terms upper thread and lower thread are not restricted to any specific spatial definitions of "upper" and "lower". By lower thread there is meant in this connection generally a thread which comes from a thread supply location, for example, a delivery or supply coil or a creel bobbin, or which comes from a thread producer. The upper thread is a thread leading to a thread take-up location. For example a take-up coil or a winding beam. In this regard, the thread travel direction may extend from below to above as is the case for the embodiments described herein. Thread travel may, however, also be in opposite direction or may have an altogether arbitrary direction in space such as a horizontal course, for example.

Although the described embodiments are concerned with a travelling device for tying the threads, nevertheless, a device according to the invention may obviously also be located at each individual work station. The device according to the invention is usable, for example, with spinning machines, creels, tufting machines and the like, besides winding machines.

In the embodiments of the invention of the instant application, the threads are crossed in making ready for the splice. It may be advantageous, however, to lay the threads uncrossed into the splicing chamber.

The provision of a suction air dosing valve is not absolutely necessary. If such a valve is omitted, the regular or established suction air current can become a source of trouble, though, because dust particles are continuously being sucked in from the ambient air and, together with fibers or thread ends, may plug up the injectors. Also disadvantageous would be the continuous loss of compressed air.

It has been found to be advantageous to close the splicing chamber by means of a cover during the splicing operation, however, closing of the splicing chamber is not absolutely required. By special construction of the laying-in slot and by special air guidance, the splicing operation will be successful even if the splicing chamber remains open at the side in which the threads are laid in.

Better results are obtained with the method and device of the invention when the splicing chamber is closed.

The foregoing is a description corresponding to German Application No. P 31 32 895.4, dated Aug. 20, 1981, the International priority of which is being claimed for the instant application and which is hereby made part of this application. Any discrepancies between the foregoing specification and the aforementioned corresponding German application are to be resolved in favor of the latter.

I claim:

1. Method of joining an upper thread to a lower thread by means of a device having a splicing chamber formed with an elongated slot for laying-in and tying the threads, including mutually tying the threads by splicing with compressed air acting thereon from a side, moving a thread regulator from a thread take-up location to a thread delivery location for laying-in the threads into the elongated slot of the splicing chamber, automatically severing the ends of the upper and the lower threads, blowing compressed air into the splicing chamber, and sucking in and firmly holding each newly formed shorter thread end by means of an air current, which comprises producing the air current for sucking-in and firmly holding the thread ends as a suction air current by means of an injector to which compressed air is admitted, and guiding the suction air current simultaneously in an approximately helical path.

2. Method according to claim 1 wherein the elongated slot is coverable, and which includes closing the elongated slot with a cover in accordance with the position of the thread regulator.

3. Device for performing a method of joining an upper thread to a lower thread, comprising a splicing chamber formed with an elongated slot for inserting and joining the threads therein, a compressed-air channel terminating in an interior space of said splicing chamber, at least one thread regulator movable from a thread take-up position into a thread delivery position for laying the threads into said elongated slot of said splicing chamber, and controllable parts depending upon the position of said thread regulator including thread severing mechanisms for separating the ends of the upper and the lower threads, a controllable compressed-air dosing valve, a pneumatic device located above said splicing chamber for taking-up the shortened thread end of the lower thread, a pneumatic device disposed below said splicing chamber for taking-up the shortened thread end of the upper thread, at least one of said pneumatic devices having an injector to which compressed air is admissible, a pneumatic line extending from said injector to a thread suction mouthpiece, said pneumatic line having at least one lateral opening therein for admitting thereto a flow of surrounding air.

4. Device according to claim 3 wherein said elongated slot is coverable, and including a cover for transitorily closing said splicing chamber.

5. Device according to claim 3 wherein said at least one lateral opening is an elongated slot.

6. Device according to claim 3 wherein said at least one lateral opening is a plurality of openings.

7. Device according to claim 3 wherein said at least one lateral opening comprises an elongated slot and a plurality of other openings.

8. Device according to claim 3 wherein said at least one lateral opening is adjustable.

9. Device according to claim 3 wherein said at least one lateral opening is closable.

10. Device according to claim 9 wherein said pneumatic line has means for closing said lateral opening.

11. Device according to claim 10 wherein said closing means comprise a rotary slide valve.

12. Device according to claim 3 wherein said thread suction mouthpiece flares funnel-like outwardly.

13. Device according to claim 3 including a common compressed air source connected to said splicing chamber and to said injector.

14. Device according to claim 13 wherein said compressed-air dosing valve is common to both said splicing chamber and said injector.

15. Device according to claim 3 wherein said at least one lateral opening is directed opposite to the direction of twist of the threads.

* * * * *